US005495867A

United States Patent [19]

Block

[11] Patent Number: 5,495,867

[45] Date of Patent: Mar. 5, 1996

[54] DUAL HANDLED CANE

[75] Inventor: Randall D. Block, Salt Lake City, Utah

[73] Assignee: Momentum Medical Corp., Salt Lake City, Utah

[21] Appl. No.: 153,456

[22] Filed: Nov. 16, 1993

[51] Int. Cl.[6] ..... A61H 3/02

[52] U.S. Cl. ..... 135/65; 135/72; 135/73

[58] Field of Search ..... 135/65, 68, 71, 135/72, 73

[56] References Cited

U.S. PATENT DOCUMENTS 1,400,394 1/1921 Warry ..... 135/65 X (List continued on next page.)

FOREIGN PATENT DOCUMENTS 0567891 6/1958 Belgium ..... 135/68
2587599 3/1987 France .
3839008 5/1990 Germany .

(List continued on next page.)

OTHER PUBLICATIONS

Alexander et al., "Rising From a Chair: Effects of Age and Functional Ability on Performance Biomechanics", Journal of Gerontology: Medical Sciences, vol. 46, No. 3, pp. M91–98, 1991.

Burdett et al., "Biomechanical Comparison of Rising from Two Types of Chairs", Physical Therapy, vol. 65, No. 8, pp. 1177–1183, Aug. 1985.

George et al., "Aids and adaptations for the elderly at home: underprovided, underused, and undermaintained", British Medical Journal, vol. 296, pp. 1365–1366, May 14, 1988.

Ikeda et al., "Influence of Age on Dynamics of Rising from a Chair", Physical Therapy, vol. 71, No. 6, pp. 473–481, Jun. 1991.

Mulley et al., "Everyday Aids and Appliances–Walking Sticks", British Medical Journal, vol. 296, pp. 475–476, Feb. 13, 1988.

Munton et al., "An Investigation Into The Problems Of Easy Chairs Used By The Arthritic And The Elderly", Rheumatology and Rehabiliation, vol. 20, No. 3, pp. 164–173, 1981.

Nova et al., "Design And Use Of Improved Walking Aids", J. Biomed Eng., vol. 7, pp. 329–333, Oct. 1985.

Rodosky et al., "The Influence of Chair Height on Lower Limb Mechanics During Rising", Journal of Orthopaedic Research, vol. 7, No. 2, pp. 266–271, 1989.

Sainsbury et al., "Walking sticks used by the elderly", British Medical Journal, vol. 284, p. 1751, Jun. 12, 1982.

Schultz et al., "Biomechanical Analyses Of Rising From A Chair", J. Biomechanics, vol. 25, No. 12, pp. 1383–1391, 1992.

Wasson et al., "Clinical Reviews–The Prescription of Assistive Devices for the Elderly: Practical Considerations", Journal of General Internal Medicine, vol. 5, pp. 46–54, 1990.

Weiner et al., "When Older Adults Face the Chair–Rise Challenge", JAGS, vol. 41, No. 1, pp. 6–10, Jan., 1993.

Wheeler et al., "Rising from a Chair–Influence of Age and Chair Design", Physical Therapy, pp. 22–26, 1985.

*Primary Examiner*—Carl D. Friedman
*Assistant Examiner*—Wynn E. Wood
*Attorney, Agent, or Firm*—Trask, Britt & Rossa

[57] ABSTRACT

A dual handled cane having the handles spaced at a predetermined distance to provide excellent uprisal characteristics is disclosed. The cane is a unitary structure having an upper handle which is useful whenever a user is in a standing position. A lower handle is spaced a preselected distance from the upper handle and a preselected distance from the tip of the cane. An infirmed user can use the lower handle as a grip when the user is rising from a chair. The second handle is connected to the shaft of the cane, that is, the straight shaft portion of the cane by a gooseneck wherein both handles are geometrically centered over the load bearing shaft of the cane. A load bearing shaft generally comprises two elements; one, a telescoping lower element which includes the tip of the cane and an upper element into which the lower element slides so that the length of the shaft may be adjusted to fit more comfortably the height of a particular individual.

8 Claims, 6 Drawing Sheets

U.S. PATENT DOCUMENTS

| | | | |
|---|---|---|---|
| 2,788,793 | 4/1957 | Abbott | 135/68 |
| 3,133,551 | 5/1964 | Murcott | 135/73 X |
| 3,157,187 | 11/1964 | Murcott | 135/73 X |
| 3,289,685 | 12/1966 | Parker | 135/65 |
| 4,121,605 | 10/1978 | Schmerl . | |
| 4,274,430 | 6/1981 | Schaaf et al. | 135/65 |
| 4,428,390 | 1/1984 | Baird | 135/68 X |
| 4,562,850 | 1/1986 | Earley et al. . | |
| 4,583,080 | 4/1986 | DiVito et al. . | |
| 4,625,742 | 12/1986 | Phillips et al. . | |
| 4,787,405 | 11/1988 | Karwoski | 135/65 X |
| 4,941,495 | 7/1990 | Boyce et al. . | |
| 5,193,567 | 3/1993 | Razny, Jr. | 135/68 |
| 5,201,334 | 4/1993 | Tseng | 135/72 X |
| 5,318,058 | 6/1994 | Zimmerman | 135/71 X |

FOREIGN PATENT DOCUMENTS

| | | | |
|---|---|---|---|
| 0482442 | 1/1970 | Switzerland | 135/71 |
| 0702634 | 1/1954 | United Kingdom | 135/68 |
| 2136290 | 9/1984 | United Kingdom . | |

DUAL HANDLED CANE

BACKGROUND OF THE INVENTION

1. Field of the Invention

The instant invention relates to walking canes having auxiliary handles to assist a seated person to rise to a standing position.

2. State of the Art

Various types of devices have been utilized to assist people recovering from various types of injuries and surgery or experiencing weakness or instability from conditions associated with advanced age or other causes to help such a person move from a seated position to a standing position.

Complicated devices such as tilting chairs and the like have been utilized. Also, various types of four legged walkers and devices designed to be supported by a chair or bed have been utilized for this purpose.

Although the problem has existed from time immemorial, it still receives considerable attention from the medical community and numerous articles have been recently written. Exemplary articles of this type include the following:

"Rising from a Chair: Effects of Age and Functional Ability on Performance Biomechanics," *Journal of Gerontology: Medical Sciences*, v. 46, n. 3 (1991), M91–98 by Alexander, Schultz and Warwick.

"Walking Stick Used by the Elderly," *British Medical Journal*, v. 284, p. 1751, 12 Jun. 1992, Sainsbury & Meilley.

"Every day Aids a Appliances—Walking Sticks," *British Medical Journal*, v. 296, 13 Feb. 1988, Mulley.

"The Influence of Chair Height on Lower Limb Mechanics During Rising," *Journal of Orthopaedic Research* (1989), 7:266–271.

"Design and Use of Improved Walking Aids," *J. Biomed Eng.*, v. 7, Oct. 1985, Nava and Laura.

These articles discuss several matters including the desirability of arm rests on chairs in assisting uprisal in preference to greater chair height, the desirability of correctly sizing the height of a walking stick and the necessity of walking sticks for a significant portion of the population over age 75. Also, a retractable crutch which can have its shoulder support lowered to assist a person during seating from a standing position is discussed. This crutch, discussed in the last cited article, has a spring which compresses to provide a "stored" force to raise the shoulder piece to a fully extended height upon spring release prior to uprisal.

Developers in the field have given attention to the problem and various cane or cane-like devices are disclosed in a number of patent or patent-related documents. British patent application No. GB2136290A of Walker, U.S. Pat. No. 3,289,685 of Parker, and U.S. Pat. No. 4,562,850 to Early et al. disclosed devices with a plurality of handles and a cane-like structure. Also, the patent to Warry, U.S. Pat. No. 1,400,394 discloses a telescoping crutch-like device with a single shaft wherein an auxiliary handle may be gripped when the crutch is fully extended so that its top support fits under the arm of an individual.

The device of Walker has four handles at the top of the device wherein the lower handles may be gripped by a person seated for the purpose of pulling on the handles with the device in a frontal position to attempt to pull oneself into a standing condition. The upper and lower handles of the Walker device are located close to one another and the device is such that it has two pair of handles located at two different levels of the cane. The device of Parker has two handles, but the handles are not located with their geometric centers above the shaft member. The principal use of the two handles of the Parker cane is for stability when a user is traversing uneven terrain, although the patent mentions its use for uprisal purposes. The upper and lower handles of Parker are relatively close together, e.g., about six inches. Thus, as one attempts to use these canes, the pressure of the handles will cause some rotational force upon the wrist of the user when trying to rise from a seated position and since many users have arthritic conditions, torque on the wrist is generally to be avoided. Furthermore, the handles of the Parker device are sufficiently so close together that one utilizing such a cane, especially alongside a chair, would experience an uncomfortable position for the wrist, hand, and forearm because of the limited space available between the handles. Again, as with the Walker device, the more comfortable and biomechanically advantageous position to which to use a cane for uprisal purposes, is alongside a chair and close to one's center of gravity when seated. The close proximity of the two handles of Parker does not really permit this type of convenient use of the device so one can push down upon a lower handle rather than trying to pull oneself into an erect position.

The device of Early has a collar close to the handle of the cane wherein the collar provides a small surface for a person to try to pull on to pull oneself into a standing position. The collar is too close to the handle to be used in a pushing-down motion and again it appears that this is a cane structured toward use in front of a seated user.

Another patent having a supplementary handle is U.S. Pat. No. 4,121,605 to Schmerl which has a rather long stabilizing bar which is pivoted in close proximity to the cane handle wherein the bar may be rotated to a substantially perpendicular position with respect to the cane shaft wherein a second hand may be comfortably placed along the stabilizing bar when a user of the cane has his or her other hand on the cane handle and is apparently in a standing position. This bar is also located close to the main cane handle so that it would not be useful in assisting a person rising from a chair unless that user was trying to pull on the stabilizing bar.

Other structures, such as that illustrated in U.S. Pat. No. 4,941,495 of Boyce et al. have also been utilized to provide uprisal aid. This device has a pair of "arm rests," which are laterally spaced a sufficient distance to encompass the hips of a user. These "arm rests" provide hand support for a person rising from a seated to a standing position.

SUMMARY OF THE INVENTION

The instant invention provides a cane structure which is both ergonomically and biomechanically structured to provide a user with a pair of handles, the top handle being useful when user is in a standing position and the lower or second handle which is sufficiently low that a user can place the cane along side himself or herself while in a seated position and push down on the second handle to assist in rising to a standing position. The second handle is spaced a sufficient distance from the top handle to provide comfort and not block the lower portion of the forearm when the handle user is gripping the second handle. Both handles are preferably located such that their geometric centers are located essentially directly over the load-bearing shaft of the cane.

The cane of the instant invention is preferably a single continuous structural member which forms the two handles, a curved web connecting the two handles and connects the lower handle by a gooseneck shape to the load-bearing shaft of the cane. The load-bearing shaft may terminate at its distal end with a ground contact surface. The shaft may be hollow to receive a telescoping cane extension member which may be adjusted to provide a cane having various lengths.

One particular embodiment of the instant invention is one in which an upper handle is substantially parallel to a lower handle and is connected by a web member which is preferably cylindrical or tubular in cross section and which is integral with the handles. The lower handle is connected to the main stem or shaft by a gooseneck type curve with the whole structure being an integral one-piece structure. The presence of these multiple curved portions provides some shock absorbing characteristics to the cane.

The cane is unique in having multiple curved sections, which in certain configurations are pleasingly attractive. Also, shock absorbing characteristics are provided by many of these unique canes, which is quite desirable for persons having arthritic wrists, elbows, and shoulders.

The height of a seat of an average chair is about 16 to 17 inches. The cane of the instant invention is designed and structured preferably to have a lower handle which is preferably substantially geometrically centered over the load-bearing shaft at a location on the cane which is generally only slightly higher from the tip of the cane than the height of the average chair seat is from the floor. Thus, a height of the second handle from the tip of the cane is generally from about 16 to 25 inches depending from the height of the user of the cane and is preferably about 17 to about 24 inches. A telescoping extension member for the cane can generally provide about 6 to 8 inches of adjustment so that a single cane may provide a desirable distance from the second handle to the tip for a wide variety of individuals of varying height.

The first handle or top handle is preferably at least about nine inches above the lower handle and is generally from about to 10 to about 16 inches above the lower handle. A minimum distance of about 9 inches is desirable so that when a user is in a seated position and is grasping the lower handle for uprisal purposes, the upper handle does not block the forearm and cause the user to have a bent wrist when trying to push himself or herself up from a seated position.

Generally it is preferred that the cane be structured from a single continuous element and that both handles are substantially geometrically over the load bearing shaft of the cane. Alternative structures, however, are quite useful. For example, the cane may be made wherein the top handle and the main cane body are one structural element wherein there is a compound curve joining a relatively long straight upper portion and a straight load-bearing shaft (lower portion) and an adjustable handle attached to the straight upper portion so that varying distances can be attained between the top handle and the lower, adjustable handle on the same cane. In such a structure, it is of course useful to utilize a telescoping shaft extension member so that the overall height of the cane can be adjusted to fit varying heights of individuals to ensure that the top handle is at a comfortable location when a user of the cane is in a standing position. In such a structure, it is again preferred that the handles can be positioned so that they are each geometrically centered over the load-bearing shaft of the cane. Further understanding of the invention may be made by reference to the attached drawings.

DETAILED DESCRIPTION OF THE INVENTION

The instant invention provides a cane structure which has a number of advantages. Generally, it is light weight and has a pair of handles which are spaced a predetermined distance and geometrically centered with respect to the longitudinal axis of the load-bearing shaft of the cane. Secondly, the handles are spaced sufficiently far apart that the hand, wrist and forearm are generally in a comfortable position between the handles while one hand grips the lower handle for uprisal purposes. Thirdly, the lower handle is at a predetermined distance from the ground engaging portion of the cane so that when the cane is in a vertical position, the lower handle is comfortably located for a seated user to hold and to push down on the lower handle so that the user can raise himself or herself from a seated position.

Figure 1:
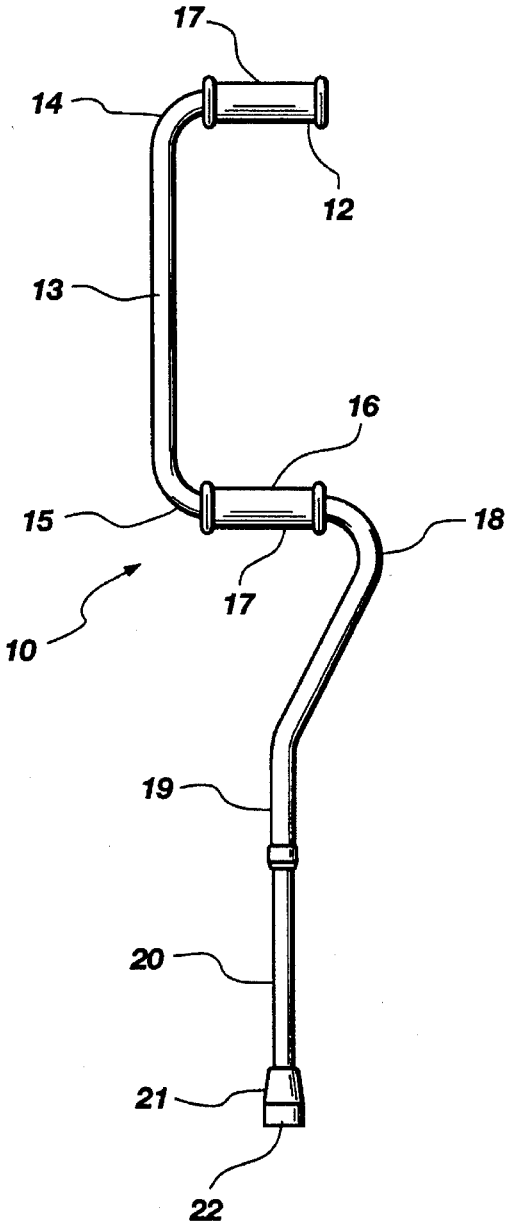
FIG. 1 is an elevational view of a two-handled cane of the instant invention.

A preferred embodiment of the instant invention is illustrated in FIG. 1. The cane 10 is composed of a single continuous member beginning at its top with a handle 11 having a soft covering 12, a web member 13 connecting handle 11 to handle 16, also having a soft, durable covering 17. The web member 13 is joined to the handles by curved portion 14 and another curved portion 15. A gooseneck curved portion 18 connects handles 16 to load-bearing shaft 19. An adjustable shaft extension 20 telescopes within tubular section 19. At the distal end 21 of extension 20 is a rubber friction tip 22.

As illustrated in FIG. 1, handles 11 and 16 are located directly above and in line with the load-bearing shaft 19 so that when the cane is in a vertical position, the force of a user's hand on either handle is directly translated into the load-bearing shaft 19 through telescoping shaft 20 and to tip 22. Preferably, the handles have their geometric centers directly over the load-bearing stationary shaft 19.

Although for functional purposes the shape of the cane illustrated in FIG. 1 could be altered, having a multiplicity of curved joints, for example, curved sections 14, 15 and 18 provide some shock absorbing characteristics to the cane. The radius of curvature of the curved portion 14, 15 is generally from about one to four inches, and preferably from about two to three inches. Handles 11 and 16 could of course be directly butted against web 13 in a perpendicular fashion and welded to web 13 so that curved sections 14 and 15 are eliminated. Some resiliency and aesthetics may be lost by such a structure, but certain other advantages may accrue, for example, if web 13 is made into two sections wherein one section telescopes into the other, then having a long straight web without any curved ends could be advantageous. Also, gooseneck 18 could be a tight U-turn with a substantially 90° curve connecting that portion of the cane to load-bearing element 19.

In the cane of the instant invention, it is generally desired to have a distance of about nine inches minimum between handles 11 and 16. A preferred distance is about 10 inches to a maximum of about 16 inches. For general use, three models may be made which will satisfy the needs of people of widely varying heights. A smaller model having a distance between handles of 10 inches plus or minus one inch, a middle model having a distance between handles of 13 inches plus or minus one inch and a model for taller people having a distance between handles of 16 inches plus or minus one inch have been found very useful. The distance from lower handle 16 to the distal end 21 of telescoping element 20 is generally from about 17 to 25 inches and preferably from about 19 to about 24 inches with an optimum distance of 22 inches. An overall height for the cane is generally from about 29 to about 42 inches. If the space between handles is about 16 inches, then the distance from the lower handle to the distal end of the cane would be generally about 24 inches to achieve an overall height of about 40 inches. Such a cane would generally be intended for a person over 6 feet tall and would accommodate people of over six feet six inches in height.

In models having a distance between handles of about 10 inches, a preferred distance of lower handle to the tip of the cane would be about 19 inches to achieve an overall height of about 29 inches. Such a cane would accommodate people of a height of about 5 feet. A model having a distance between handles of about 13 inches generally has a height or distance between the lower handle and the distal end of the cane of about 22 inches. This height would accommodate people of a height in the mid-five feet to six feet range.

Generally, the cane is made with a telescoping shaft of a type which is currently in use with aluminum canes to provide some adjustment of up to several inches to achieve an adjustable height for any cane so that a full range of heights between about 29 inches and 40 inches is achievable with three cane models. By having a sharp U-bend instead of gooseneck 18, a longer straight load-bearing shaft 19 may be achievable so that extension element 20 may have a longer run of travel, which could result in more adjustability of overall height and adjustability of distance between the lower cane handle and its distal end.

The shaft diameter of the cane of the instant invention is generally from about three-fourths to about one inch plus or minus one-quarter inch. Aluminum tubular canes generally have an outer diameter of about seven-eights inch. The cane may be made out of wood, tubular aluminum, tubular steel or a solid, composite material such as a fiberglass reinforced resin or carbon fiber composite. Tubular aluminum material is generally preferred because of its availability, its formability, its strength and its lightness of weight. A carbon fiber composite cane would be very strong and light-weight and could be readily formed. Generally, a carbon fiber composite cane would be much stronger than aluminum and would have great flexural strength. For example, if the cane were sat upon and bent, the cane would return to its original position, while a tubular aluminum cane under similar circumstances might be bent to a point that the aluminum would be creased and the bend would be permanent unless the cane were re-straightened. The shock absorbing characteristics of the cane are maintained regardless of materials of construction provided that the curved sections are engineered to have some flexural characteristics.

Figure 2:
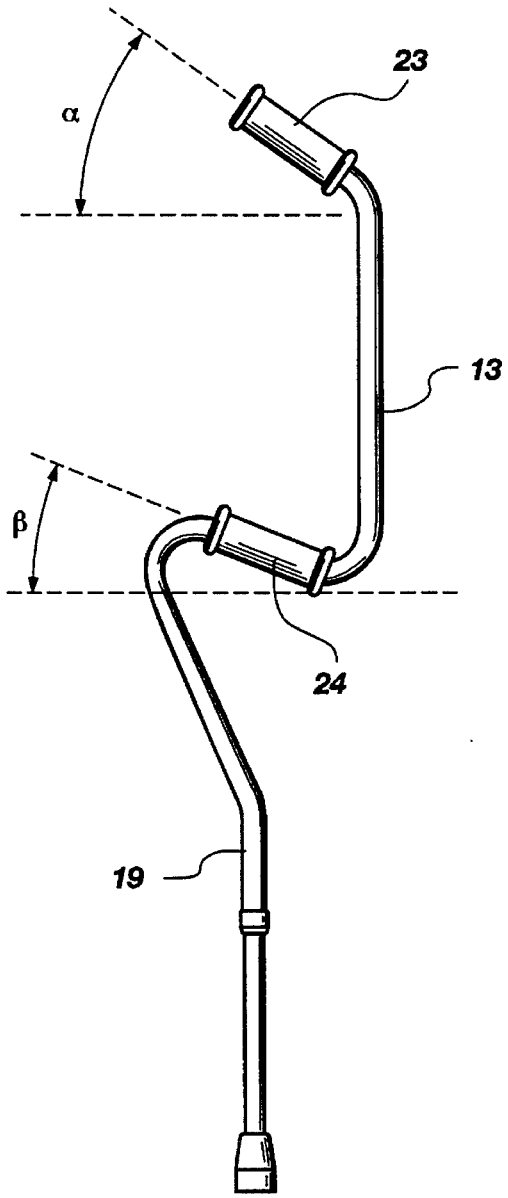
FIG. 2 is an elevational view of a two-handled cane similar to FIG. 1 with inclined handles.
Figure 3:
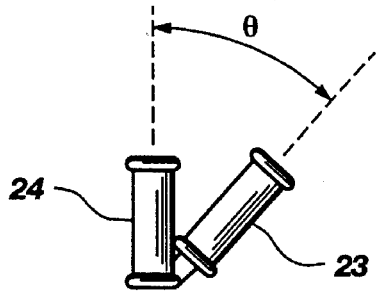
FIG. 3 is a plan view of a two-handled cane of the type illustrated in FIGS. 1 or 2 wherein the handles are angularly related when viewed from a top view.

Other structures of the instant invention may be utilized. For example, in FIGS. 2 and 3, alternative structures are shown by way of example. In FIG. 2, the handles are inclined at an angle of greater than 90° with respect to a central longitudinal axis running through the load-bearing shaft 19. The angle alpha for handle 23 may be from about 90° to about 135° with respect to said central longitudinal axis. The same is true of angle beta for the lower handle 24. Also, as illustrated in FIG. 3, the top handle and lower handle may be in a different plane. That is, the handles may be adjustably rotated about angle theta in a horizontal aspect. Angle theta may be from 0° to about 45°.

Generally, the canes of the instant invention are planar. That is, all elements are within one plane. This is desirable from the standpoint of balance and having the cane lie flat when it is being placed for storage or transport. Also, if the handles, for example, 23 and 24 are not coplanar, but are rotated as illustrated FIG. 3, then the handles are not both directly over the load-bearing member 19. For example, in FIG. 3, handle 24 is offset from the geometric center of handle 23. The lower handle preferably would have its geometric center located directly over the load-bearing member 19.

In the example of FIG. 3, it may be that web 13 is equipped with a rotational joint so that handle 23 may be selectively rotated and fixed into position. For example, handle 23 could be rotated about a longitudinal axis to an angle of 45° or even more, for example, up to 90°, to rotate that handle so that when the user is grasping handle 24 for raising himself or herself from a seated position, he or she may also grasp handle 23 in the most comfortable orientation for that person.

Figure 4:
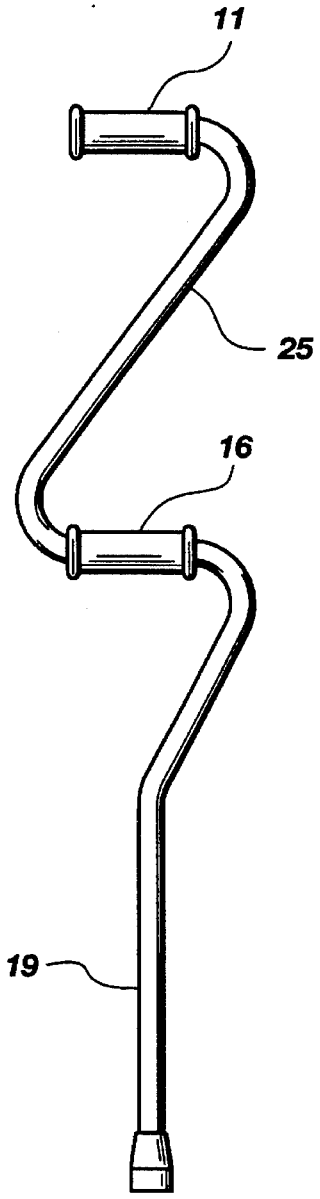
FIG. 4 is an elevational view of a two-handled cane having a Z-shaped tubular member connecting said handles.

Another cane configuration is illustrated in FIG. 4 which has a Z-shaped configuration at its upper end. Handles 11 and 16, which are shown as having a substantially horizontal aspect when the cane is in a vertical position, are joined together by a Z-shaped web 25. Because web member 25 has curved sections at either end that are greater than 90°, the cane illustrated in FIG. 4 may have greater shock absorbing characteristics than the cane of FIG. 1, for example. However, Z-shaped web 25 may be less convenient than the web of the FIG. 1 cane when handle 16 is grasped by a user wanting to rise from a sitting to a standing position.

In the cane illustrated in FIG. 2, the handles may be declined as well as inclined, or one handle may be declined while the other is inclined. In the illustrated cane of FIG. 2, for the purposes of this application, it is considered that those handles are inclined because the top end of the upper handle 23 is higher than its other end. Handle 23 could be declined wherein in the free end is lower than its upper end without any change in handle 24 or handle 24 may be declined and handles 23 and 24 could then both be declined and may be maintained in a parallel relationship, if desired, or the angle of declination could be different for each.

The cane illustrated in FIG. 2 may be utilized with the heel of the hand at the upper end of handle 23 or with the heel of the hand at its lower end. This is also true of handle 24, thus primarily rotating the cane 180° about its central longitudinal axis. The angular aspect of the handles may be changed from an inclined one to, in effect, a declined position. That is, assuming that the user's hand is still approaching from the same direction. In the cane of FIG. 2, if a hand is coming from the left, then the handle 23 is inclined. If the cane is rotated 180° and the hand is still approaching from the left, then the handle would in, effect be, gripped in a declined position.

Figure 5:
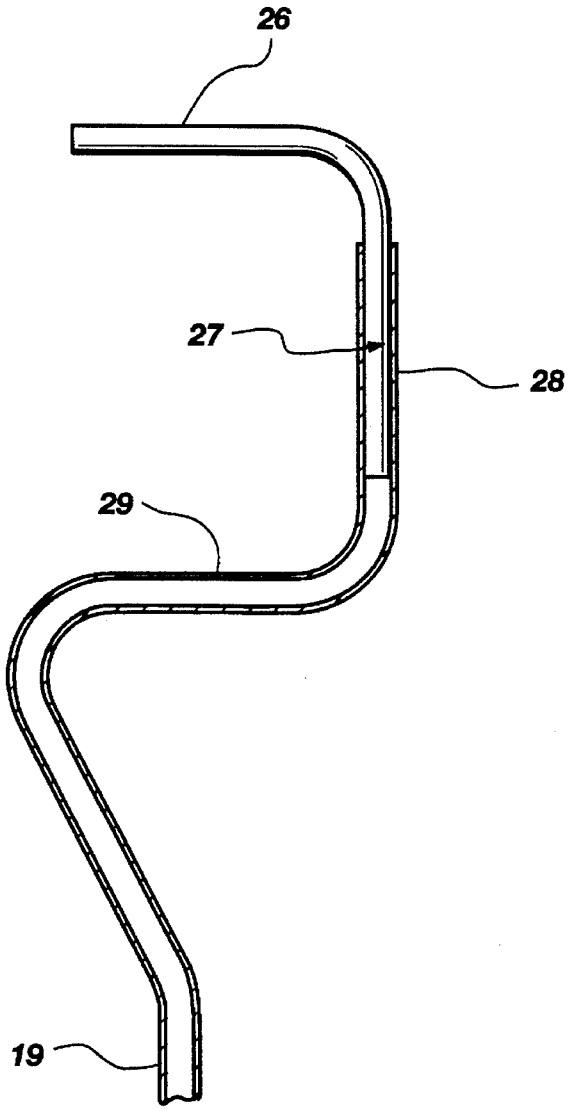
FIG. 5 is an elevational view of a two-handled cane wherein the handles are connected by a web structure comprising two tubular members which may telescope and/or rotate with respect to one another.

Another embodiment of the invention is illustrated in FIG. 5. Handle 26 is attached to member 27 at substantially right angles. Member 27 telescopes within member 28. Members 27 and 28 constitute a telescoping web, and wherein handle 29 is attached to member 28. Thus, upper handle 26 may be adjusted upwardly or downwardly with respect to handle 29 to give greater comfort of cane use by people of varying heights. Also, member 27 may be made so that it rotates with respect to member 28 so that upper handle 26 can be rotated horizontally when the cane is in an upright position to move said handle to a comfortable position so that a person gripping handle 29 may also comfortably grip handle 26.

Figure 6:
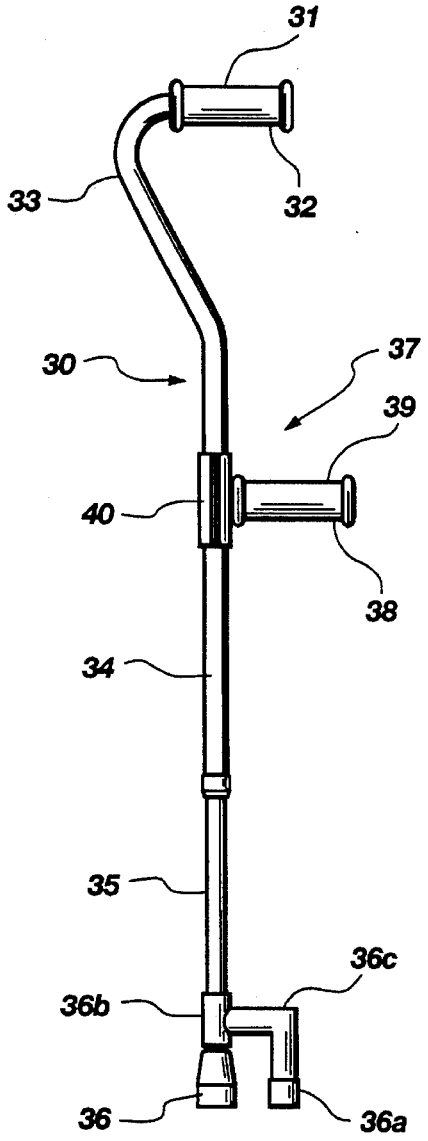
FIG. 6 is an elevational view of a conventional cane with an adjustable, removable handle attached to the cane shaft.

Some of the advantages of the cane illustrated in FIG. 1 and other of the illustrations may be achieved by adding an auxiliary handle to a standard cane, as is illustrated in FIG. 6. The cane 30 is one which is currently available in various types of stores and has been used for quite some time. It is a light weight aluminum cane having a single handle 31 with a covering 32 connected to a gooseneck 33 which is connected to a straight shaft 34. It has a telescoping shaft extension 35 and a standard rubber-type tip 36. An auxiliary handle which is adjustable along the length of the shaft 34, is illustrated. The handle assembly 37 has a handle member 38 with a covering 39 on it. The handle is attached at about a right angle to a cylindrical type sleeve 40 which is secured to the shaft 34 by pressure means. Generally, it is preferred that no holes be required in the cane to accept an auxiliary handle.

Figure 7:
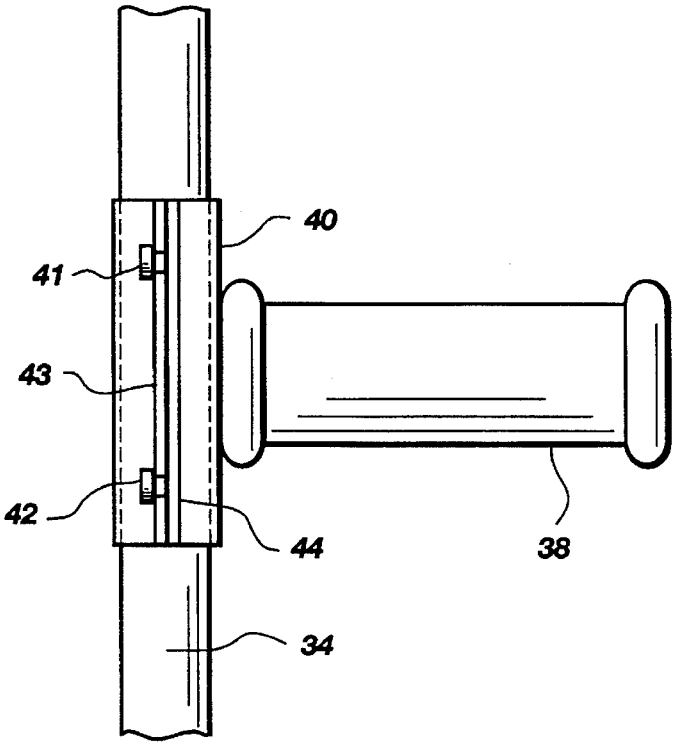
FIG. 7 is an elevation view of an auxiliary cane handle having a cane-engaging, split-sleeve member.

A more detailed view of the handle is illustrated in FIG. 7 wherein the cylindrical sleeve 40 is a split sleeve wherein two half sleeves are joined together by screws 41 and 42 and two other screws not shown. It also may be a split sleeve which is joined together by two screws wherein the sleeve is split only along one edge. In the embodiment illustrated in FIG. 7, the screws pass through a flange member 43 and screw into another flange member 44 to tighten the sleeve upon the cane shaft which is illustrated in the dotted lines 34. Thus, the auxiliary handle is removable and is adjustable along the length of shaft 34.

This type of handle may be used for assisting a person in rising or returning to a seated position. The handle 38 is preferably oriented at about 90° with respect to the main longitudinal axis of the sleeve member 40. Use of the handle assembly such as illustrated in FIG. 7 is not as advantageous as the handle members of canes similar to that illustrated in FIG. 1 inasmuch as the handle of FIG. 7 is not geometrically centered over the longitudinal axis of the shaft member. Thus, some torque may be realized upon the hand when the handle assembly of FIG. 7 is attached to the straight shaft of a cane. This may be compensated to some extent by tilting the cane backward when a user is griping the handle so that the cane shaft is to the rear of the arm gripping the handle. This way the handle may be oriented so that it is at least directly over the foot of the cane so that the pressure being exerted on the auxiliary handle goes directly along a substantially vertical axis passing through the handle and the foot of the cane.

To compensate for the offset of the auxiliary handle from the shaft of the cane, it is possible to use an auxiliary foot member as well, wherein the foot member attaches to the base of the telescoping extension shaft so that a second foot 36A is provided, wherein the auxiliary foot assembly has a sleeve, which may be a split sleeve, 36B connected to an angular support member 36C which is structured with an angle of about 90° to connect the sleeve 36B to the auxiliary tip 36A. The structure of the auxiliary foot assembly should be such that the auxiliary tip 36A is spaced a sufficient distance from tip 36 so that auxiliary foot 36A is aligned substantially with the geometric center of handle 37 when the cane is in a vertical position.

Figure 8:
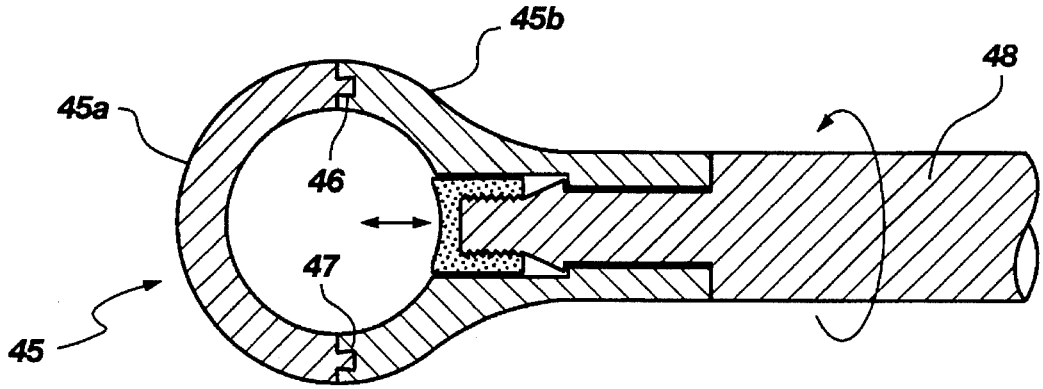
FIG. 8 is a plan view of an auxiliary cane handle having a split sleeve member joined together by a pair of dove-tail joints.
Figure 9:
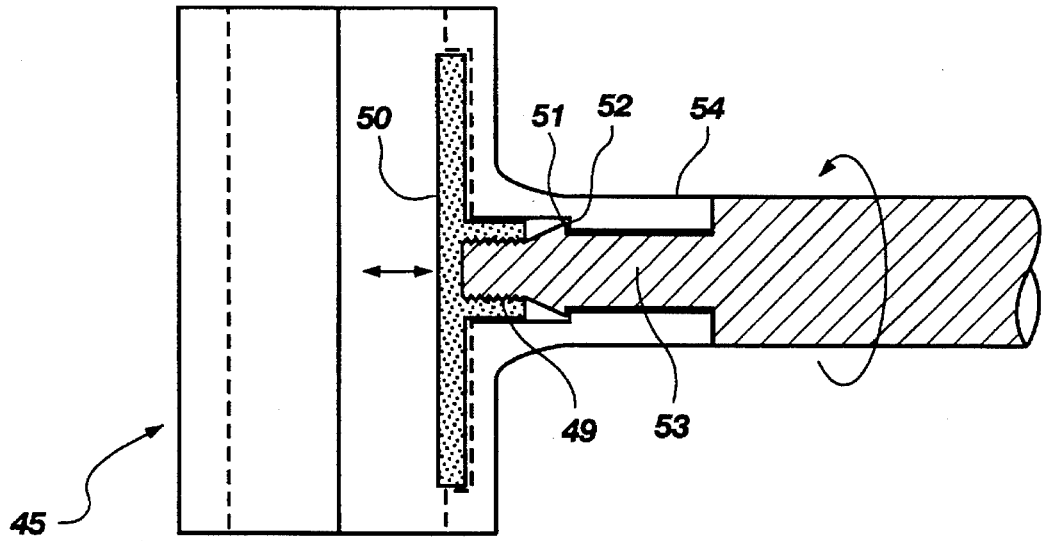
FIG. 9 is an elevational view of the auxiliary cane handle of FIG. 8 in which the pressure attachment mechanism is illustrated.

It is to be understood that all of the unique canes described herein may be fitted with a tripod or quadrapod foot to create more stability for persons desiring such additional stability. Another type of auxiliary handle is illustrated in FIGS. 8 and 9 wherein a split sleeve member 45 has two components 45A and 45B which are joined by a dove-tailed joints 46 and 47, wherein the two pieces may be slid together after they have been separated and the parts joined about the shaft of the cane. The rotation of the handle member 48 in a clockwise direction causes the threaded end 49 of handle 48 to be threaded out of pressure member 50 so that pressure member 50 is forced against the wall of the shaft of the cane. The handle member is precluded from moving backward by shoulder 51 which abuts land 52 which is part of the sleeve. Thus, the handle and sleeve are separate members and may be rotated with respect to one another, but the circular shoulder on rod 53 abuts the circular land 52 on the housing 54 attached at substantially right angles to the sleeve 45. The auxiliary handle of FIGS. 8 and 9 is advantageous in that it may be readily attached and may be readily slid along the shaft of the cane to achieve a desirable height for a lower handle.

It should be understood that the auxiliary foot member may use similar attachment means as the auxiliary handle and while not illustrated for the foot, it is intended to be within the scope of the invention that the auxiliary foot member has similarly attachment means to the auxiliary handle member.

Because an auxiliary handle member may be utilized without an auxiliary foot, it is generally preferred that the handle be directed at about a right angle to the attachment sleeve or be declined slightly from the attachment sleeve so that in the event that the cane is tilted to the rear by a user, the handle in such declined orientation may then be at a substantially horizontal position when the user is gripping that handle to come to an upright position.

Figure 10:
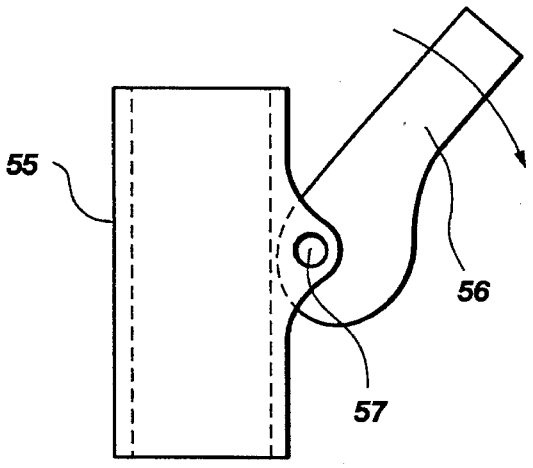
FIG. 10 is an elevation view of an auxiliary handle having a cam actuation attachment mechanism illustrated in a non-attached condition.
Figure 11:
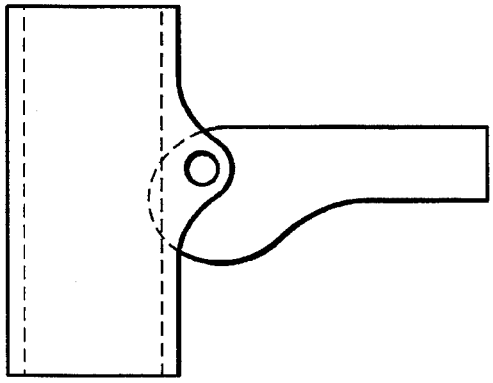
FIG. 11 is an elevational view of the handle of FIG. 10 with the cam actuation mechanism shown in an attached condition.
Figure 12:
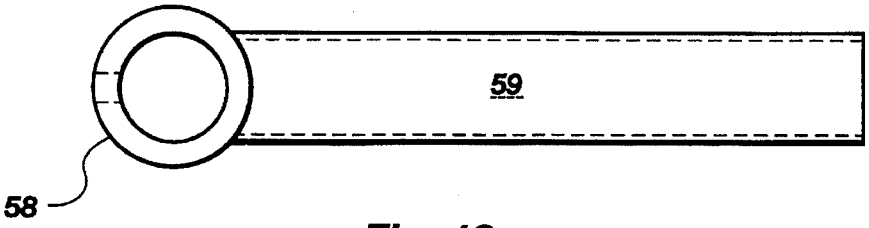
FIG. 12 is an plan view of an auxiliary handle having a sleeve member and set screw attachment means.

FIGS. 10 and 11 illustrate another embodiment of the invention wherein an auxiliary handle is attached and secured in place by utilizing the cam like action of the handle when it is moved from an upward position to an downward position. This auxiliary handle assembly is shown with a sleeve member 55. A pin secures the handle 56 to a protrusion from sleeve 55 and the pin passes through a bore in the sleeve protrusion and through a bore in the handle. The end of the handle proximate to the sleeve is rounded to have a cam-like structure wherein the bore in the handle is closer to the cam surface adjacent the sleeve when the handle is in an upright position than it is to the cam surface, that is, to a lower surface when the handle is rotated to put the lower surface of the cam in contact with the shaft of the cane. An interference type of lock is achieved. Thus, by pressure of the cam on the cane, the sleeve and consequently the handle are held securely to the cane.

Figure 13:
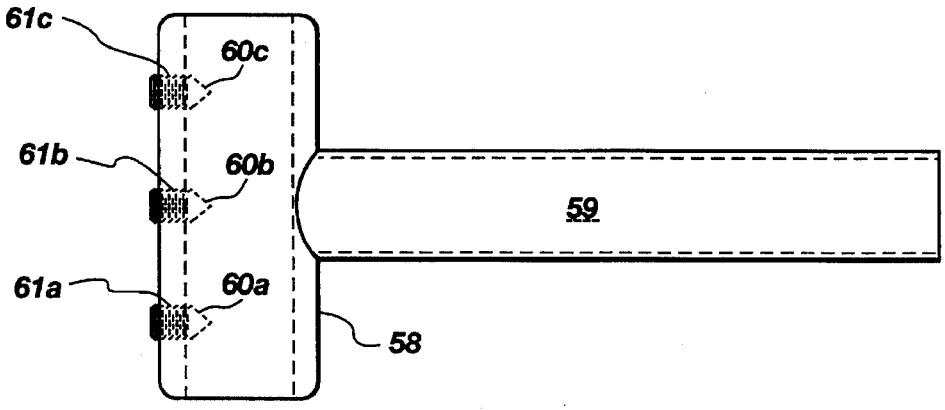
FIG. 13 is a section view along section lines 13—13 of the auxiliary handle sleeve of FIG. 12 illustrating the set screw attachment means.

Another type of auxiliary handle assembly is illustrated in FIG. 13 wherein a unitary sleeve 58 is attached in a fixed manner to a handle 59. The sleeve has three set screws 60A, 60B and 60C wherein such screws may be passed through threaded openings 61A, 61B and 61C to abut against the cane shaft to hold the sleeve in a non-sliding position when the set screws are pressing against the cane shaft. Of course, the set screws may be loosened so the sleeve 58 may be slid up and down along the handle of the cane to a different set position.

Typically, the cane shaft of a typical cane has substantially the same diameter along its length or any change in diameter is sufficiently small that the auxiliary handle assemblies described and illustrated herein may be utilized effectively with most types of canes. Canes made of tubular aluminum typically have the same diameter along the whole length of the cane shaft.

Figure 14:
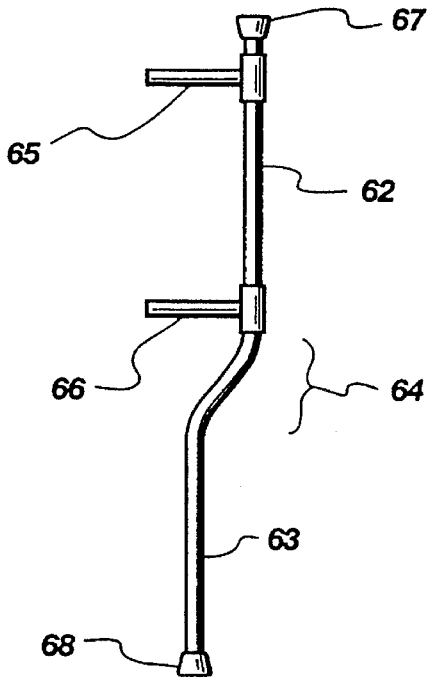
FIG. 14 is an elevational view of cane having a cane shaft with a long upper straight section to which is attached a pair of handles adapted to be spaced apart a significant distance, a lower straight shaft joined to the upper straight shaft by a section having a compound curve.

FIG. 14 illustrates a cane having an upper straight lengthy shaft member 62 and a lower straight lengthy shaft member 63 wherein the upper and lower members are joined by a cane section 64 which is a compound curve such that the axes of the upper and lower members are parallel and offset from one another. Generally, the offset is from about two to four inches. The cane is preferably made of a single continuous slender cylindrical or tubular structure.

A pair of handles 65 and 66 are attached to said upper cane member either in a fixed or adjustable attachment. The handles, if in a fixed condition, are spaced apart a minimum distance of about nine inches although a preferred optimum distance is about 13 inches.

Both the upper handle 65 and the lower handle 66 may be in a fixed relationship to upper shaft member 62 or one or both handles may be adjustable handles of the type described hereinabove.

In the cane embodiment illustrated in FIG. 14, the length of the upper shaft member 62 may be as long as or greater in length than the lower shaft member 63. Lower shaft member 63 may, of course, comprise two telescoping elements so that the lower shaft member can have an adjustable length. Upper shaft member 62 may also be made to telescope or to rotate, which may be advantageous if the handles are permanently (non-adjustably) fixed to the upper shaft.

For example, upper shaft 62 may have a length of up to about 22 inches with a lower shaft length of about 12 to 15 inches with a compound curve section length of about 4 to 5 inches to provide a cane shaft having a total height of about 42 inches. Such a cane can have adjustable handles so that any spacing desired, although less than about 20 inches, can be achieved and an upper handle height (when the cane is in use) of between about 28 to 42 inches can be achieved.

The top end of the upper shaft member may also be fitted with a rubber tip 67 for safety purposes. Also, having rubber tips 67 and 68 on both ends of the cane would permit the cane to be inverted and used by a person lying or kneeling to assist himself or herself into another position.

Figure 15:
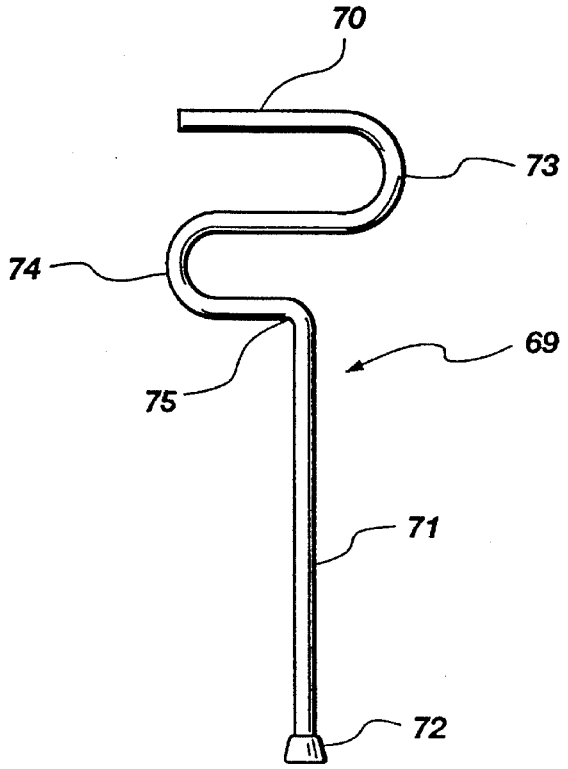
FIG. 15 is an elevational view of a cane having multiple bends to provide excellent shock absorbing characteristics to the cane.

A cane having excellent shock absorbing characteristics is illustrated in FIG. 15. The cane 69 has a handle 70 at its upper end and a load bearing shaft 71 at its lower end. At the foot of shaft 71 is a rubber tip 72. Handle 70 is connected to shaft 71 by a compound curve section wherein a first curved portion 73 is substantially a U-shaped curve, as is second curved portion 74. The third curved portion 75 is a smooth curve, preferably having an angle of radius of at least about two inches. The radii of curvatures for curves 73 and 74 are also preferably at least about two inches.

The structure of the instant cane is to provide enhanced shock absorbing characteristics to the cane, which is very desirable for people with arthritic wrists, elbows or shoulders.

A cane having multiple curves, especially three or more, with each curve greater than 90° and a total curvature of about 450° is generally preferred to enhance the shock absorbing characteristics of a cane. The cane illustrated in FIG. 5 has a total curvature of 450°.

Also, having large radii of curvature enhances the shock absorbing characteristics, e.g., a cane with a radius of curvature for at least some of the curves of greater than three inches is desirable. In effect, the further the flex point is from the central longitudinal axis of shaft 71, then the greater the torque (from hand pressure on handle 70) on the flex point and the greater the flex which will occur.

Thus, the shock-absorbing characteristics for a particular curve (of particular dimensions and material) will be influenced by 1) number of curves; 2) total amount of curvature; 3) radii of curves; 4) distance of force from flex point.

What is claimed is:

1. A walking cane having a unitary structure and a pair of vertically spaced handles to provide uprisal characteristics comprising:

a continuous slender structural member forming the body and handles of the cane and terminating in a straight shaft load bearing member having a cane tip at its distal end;

a first handle member having a lateral aspect when said can is in a vertical orientation, said first handle forming the top most portion of the cane;

a second, lower handle member spaced a predetermined fixed distance from said first handle, said lower handle having a lateral aspect when said cane is in a vertical orientation;

a web portion of the structural member joining said first and second handles, said web member joining said handles by smoothly curved portions adjacent said handles;

a gooseneck curved portion of said structural member joining said second handle to the straight shaft load bearing portion of said cane; and a straight shaft loading bearing member having a predetermined length to position said second handle a fixed preselected distance from the distal end of said cane, said shaft member positioned to have its longitudinal axis extending through said handles substantially at the geometric centers of said handles.

2. The walking cane of claim 1, wherein all portions of the cane body are within the same plane.

3. The walking cane of claim 1, wherein the cane handles are positioned at an angle of 90° ±30° with respect to a central longitudinal axis passing through the straight shaft load bearing member of the cane.

4. The walking cane of claim 1, wherein said second handle is positioned at a distance of at least about 17 inches from the distal end of said cane.

5. The walking cane of claim 1, wherein said first handle is positioned at a distance of at least about 9 inches from said second handle.

6. The cane of claim 1 wherein the spacing between said handles is about ten to about sixteen inches.

7. The cane of claim 1 wherein said second handle is spaced from the distal end of said load bearing member a distance of about seventeen to about twenty-four inches.

8. The cane of claim 1 wherein said continuous slender structural member is a tubular member.

* * * * *